US009111535B2

(12) United States Patent
Yang et al.

(10) Patent No.: US 9,111,535 B2
(45) Date of Patent: Aug. 18, 2015

(54) METHOD AND APPARATUS FOR DECODING AUDIO SIGNAL

(75) Inventors: Heesik Yang, Gyeongsangnam-do (KR); Mi-Suk Lee, Daejeon (KR); Hyun-Woo Kim, Daejeon (KR); Jongmo Sung, Daejeon (KR); Hyun-Joo Bae, Daejeon (KR); Byung-Sun Lee, Daejeon (KR)

(73) Assignee: Electronics and Telecommunications Research Institute, Daejeon (KR)

( * ) Notice: Subject to any disclaimer, the term of this patent is extended or adjusted under 35 U.S.C. 154(b) by 1124 days.

(21) Appl. No.: 13/011,273

(22) Filed: Jan. 21, 2011

(65) Prior Publication Data

US 2011/0178807 A1 Jul. 21, 2011

(30) Foreign Application Priority Data

Jan. 21, 2010 (KR) ..... 10-2010-0005775

(51) Int. Cl.
*G10L 21/02* (2013.01)
*G10L 19/093* (2013.01)
*G10L 19/24* (2013.01)

(52) U.S. Cl.
CPC ..... *G10L 19/093* (2013.01); *G10L 19/24* (2013.01)

(58) Field of Classification Search
CPC ..... G10L 19/008; G10L 19/24; H03G 7/002; H03G 7/007; H03G 3/001; H03G 3/32
USPC ..... 704/500; 381/106, 107
See application file for complete search history.

(56) References Cited

U.S. PATENT DOCUMENTS

| | | | | |
|---|---|---|---|---|
| 5,864,801 | A | 1/1999 | Sugiyama et al. | |
| 2004/0002856 | A1 * | 1/2004 | Bhaskar et al. | 704/219 |
| 2005/0149339 | A1 * | 7/2005 | Tanaka et al. | 704/500 |
| 2009/0234644 | A1 * | 9/2009 | Reznik et al. | 704/203 |

(Continued)

FOREIGN PATENT DOCUMENTS

| | | |
|---|---|---|
| JP | 6-259099 | 9/1994 |
| JP | 2002-372993 | 12/2002 |

(Continued)

OTHER PUBLICATIONS

Daudet, Laurent et al., "MDCT Analysis of Sinusoids: Exact Results and Applications to Coding Artifacts Reduction," IEEE Transactions on Speech and Audio Processing, vol. 12(3):302-312 (2004).

(Continued)

*Primary Examiner* — Brian Albertalli
(74) *Attorney, Agent, or Firm* — Nelson Mullins Riley & Scarborough LLP

(57) ABSTRACT

Provided are a method and an apparatus for decoding an audio signal. A method for decoding an audio signal encoded by a layered sinusoidal pulse coding scheme using one or more sinusoidal pulses includes decoding the encoded audio signal, setting a smoothing frequency band of the decoded audio signal according to a layer structure of the layered sinusoidal pulse coding scheme, dividing the smoothing frequency band into one or more subbands, and smoothing the decoded audio signal on a subband-by-subband basis. Accordingly, a decoding operation time can be reduced and the quality of a synthesized signal can be improved by variably setting a frequency band to be smoothed, when decoding an audio signal encoded by a layered sinusoidal pulse coding scheme using one or more sinusoidal pulses.

13 Claims, 6 Drawing Sheets

(56) References Cited

U.S. PATENT DOCUMENTS

| | | | | |
|---|---|---|---|---|
| 2010/0228557 | A1* | 9/2010 | Chen et al. | 704/500 |
| 2010/0284455 | A1* | 11/2010 | Yamanashi et al. | 375/240 |
| 2011/0002266 | A1* | 1/2011 | Gao | 370/328 |
| 2011/0004466 | A1* | 1/2011 | Morii | 704/201 |

FOREIGN PATENT DOCUMENTS

| | | | |
|---|---|---|---|
| JP | 2008-511849 | | 4/2008 |
| JP | 2008-165051 | | 7/2008 |
| KR | 1020080002996 | | 1/2008 |
| WO | 2006/108456 | A1 | 10/2006 |

OTHER PUBLICATIONS

Geiser, Bernd, et al., "Bandwidth Extension for Heirarchical Speech and Audio Coding in ITU-T Rec. G.729.1," IEEE Transactions on Audio, Speech and Language Processing, vol. 15(8):2496-2509 (2007).

Geiser, Bernd, et al., "Candidate Proposal for ITU-T Super-Wideband Speech and Audio Coding," IEEE International Conference on Acoustics, Speech and Signal Processing, pp. 4121-4124 (2009).

Geiser, Bernd et al., "Embedded Speech Coding: From G.711 to G.729-1," III. Speech Coding for Heterogeneous Networks, Advances in Digital Speech Transmission, R. Martin (Ed.), John Wiley & Sons, Ltd., Chpt. 8:201-247 (2008).

Gunnarsson, Anders et al., "Music Signal Synthesis Using Sinusoid Models and Sliding-window Esprit," ICME 2006, vol. 1:1389-1392 (2006).

* cited by examiner

METHOD AND APPARATUS FOR DECODING AUDIO SIGNAL

CROSS-REFERENCE(S) TO RELATED APPLICATIONS

The present application claims priority of Korean Patent Application No. 10-2010-0005775, filed on Jan. 21, 2010, which is incorporated herein by reference in its entirety.

BACKGROUND OF THE INVENTION

1. Field of the Invention

Exemplary embodiments of the present invention relate to a method and an apparatus for decoding an audio signal; and, more particularly, to a method and an apparatus for decoding an audio signal encoded by a layered sinusoidal pulse coding scheme using one or more sinusoidal pulses.

2. Description of Related Art

As the data transmission bandwidth increases with the development of communication technology, users' demand for high-quality communication services increases. A coding scheme capable of effectively compressing (encoding) and decompressing (decoding) voice/audio signals is necessary to provide high-quality voice/audio communication services.

Communication services have been developed focusing on narrowband codecs, but an interest in wideband codecs is also increasing due to the widespread use of VoIP. Recently, extensive research is being conducted on an extension codec technology that uses a single codec to process narrowband (NB, 300~3,400 Hz) signals, wideband (WB, 50~7,000 Hz) signals, and super-wideband (SWB, 50-14,000 Hz) signals. An ITU-T G.729.1 codec is a typical wideband extension codec based on a G.729 narrowband codec. The ITU-T G.729.1 wideband extension codec provides a bitstream-level compatibility with the G.729 narrowband codec at 8 kbit/s, and provides narrowband signals of improved quality at 12 kbit/s. Also, the ITU-T G.729.1 wideband extension codec encodes wideband signals with a bit-rate extensibility of 2 kbit/s from 14 kbit/s to 32 kbit/s, and improves the quality of an output signal with an increase in the bit rate.

Such an extension codec generally uses a layered coding structure in order to provide bandwidth and bit-rate extensibility. The layered coding structure may use different coding schemes according to frequency bands. In general, an upper layer uses a frequency-domain coding scheme in order to increase the throughput of non-voice signals. MDCT is mainly used as a frequency-domain transform scheme, and gain-shape VQ, AVQ, and sinusoidal pulse coding algorithms are used in an MDCT coefficient coding scheme.

SUMMARY OF THE INVENTION

An embodiment of the present invention is directed to a method and an apparatus for decoding an audio signal encoded by a layered sinusoidal pulse coding scheme using one or more sinusoidal pulses, which can reduce a decoding operation time and improve the quality of a synthesized signal by variably setting a frequency band to be smoothed.

Other objects and advantages of the present invention can be understood by the following description, and become apparent with reference to the embodiments of the present invention. Also, it is obvious to those skilled in the art to which the present invention pertains that the objects and advantages of the present invention can be realized by the means as claimed and combinations thereof.

In accordance with an embodiment of the present invention, a method for decoding an audio signal encoded by a layered sinusoidal pulse coding scheme using one or more sinusoidal pulses includes: decoding the encoded audio signal; setting a smoothing frequency band of the decoded audio signal according to a layer structure of the layered sinusoidal pulse coding scheme; dividing the smoothing frequency band into one or more subbands; and smoothing the decoded audio signal on a subband-by-subband basis.

In accordance with another embodiment of the present invention, an apparatus for decoding an audio signal encoded by a layered sinusoidal pulse coding scheme using one or more sinusoidal pulses includes: a decoding unit configured to decode the encoded audio signal; a smoothing frequency band setting unit configured to set a smoothing frequency band of the decoded audio signal according to a layer structure of the layered sinusoidal pulse coding scheme; and a smoothing unit configured to divide the smoothing frequency band into one or more subbands and smooth the decoded audio signal on a subband-by-subband basis.

DESCRIPTION OF SPECIFIC EMBODIMENTS

Figure 1:
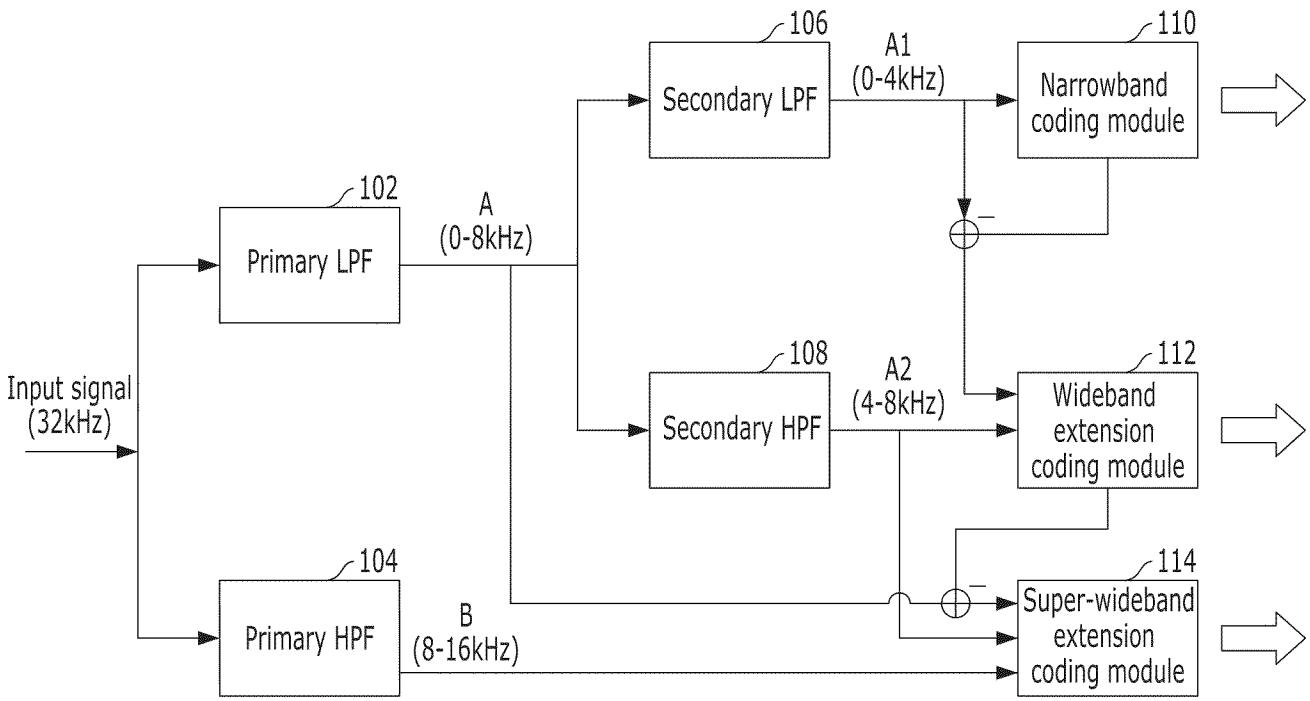
FIG. 1 is a block diagram of a super-wideband (SWB) extension codec providing compatibility with a conventional narrowband (NB) codec.

Exemplary embodiments of the present invention will be described below in more detail with reference to the accompanying drawings. The present invention may, however, be embodied in different forms and should not be construed as limited to the embodiments set forth herein. Rather, these embodiments are provided so that this disclosure will be thorough and complete, and will fully convey the scope of the present invention to those skilled in the art. Throughout the disclosure, like reference numerals refer to like parts throughout the various figures and embodiments of the present invention.

FIG. 1 is a block diagram of a super-wideband (SWB) extension codec providing compatibility with a conventional narrowband (NB) codec.

In general, an extension codec is configured to divide an input signal into a plurality of frequency bands and encode/decode a signal of each frequency band. Referring to FIG. 1, an input signal is filtered by a primary low-pass filter (LPF) 102 and a primary high-pass filter (HPF) 104. The primary LPF 102 performs filtering and down-sampling to output a low-frequency signal A (0-8 kHz) of the input signal. The primary HPF 104 performs filtering and down-sampling to output a high-frequency signal B (8-16 kHz) of the input signal.

The low-frequency signal A outputted from the primary LPF 102 is inputted to a secondary LPF 106 and a secondary HPF 108. The secondary LPF 106 performs filtering and down-sampling to output a low-low-frequency signal A1 (0-4 kHz), and the secondary HPF 108 performs filtering and down-sampling to output a low-high-frequency signal A2 (4-8 kHz).

A narrowband coding module 110 encodes the low-low-frequency signal A1. The wideband extension coding module 112 encodes a signal failing to be expressed by the narrowband coding module 110, among the low-low-frequency signal A1 and the low-high-frequency signal A2. The super-wideband extension coding module 114 encodes a signal failing to be expressed by the narrowband coding module 110 and the wideband extension coding module 112, among the low-frequency signal A and the high-frequency signal B. Thus, if only the output signal of the narrowband coding module 110 is decoded, a narrowband signal cannot be synthesized; and if all of the output signals of the three modules are decoded, a super-wideband signal can be synthesized.

Figure 2:
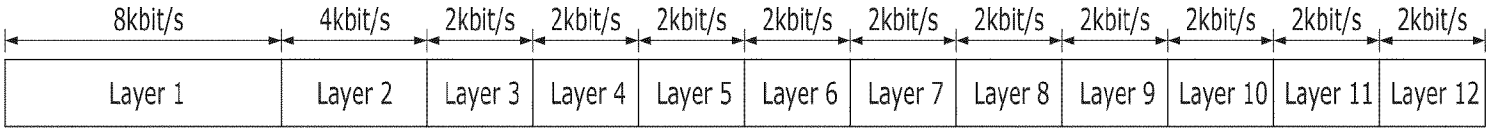
FIG. 2 is a diagram illustrating an embedded layered bitstream format of a G.729.1 codec.

An ITU-T G.729.1 codec of a layered structure based on a G.729 narrowband codec is a typical example of a variable-band extension codec illustrated in FIG. 1. The G.729.1 includes a total of 12 layers. The layer 1 provides a bitstream-level compatibility with the G.729 at a bit rate of 8 kbit/s, and the layer 2 (12 kbit/s) provides a narrowband signal having a higher quality than the layer 1. The layer 3 (14 kbit/s) to the layer 12 (32 kbit/s) encode wideband signals. Herein, the bit rate may be changed by the unit of 2 kbit/s. The quality of a synthesized signal also improves with an increase in the layer (bit rate). FIG. 2 illustrates an embedded layered bitstream format of a G.729.1 codec.

Such a variable-band extension codec may use the same coding scheme or different coding schemes according to frequency bands. For example, the layers 1 and 2 may encode narrowband signals by an ACELP (Algebraic Code Excited Linear Prediction) scheme. The low-high frequency signal and the narrowband signal failing to be expressed by the layers 1 and may be transformed and encoded into an MDCT (Modified Discrete Cosine Transform) domain. Also, the high-frequency signal may be transformed and encoded into an MDCT domain.

The MDCT-domain coding scheme applies an MDCT transform to a time-domain signal and encodes information about an obtained MDCT coefficient. Herein, the MDCT coefficient is divided into a plurality of subbands, and the shape and gain of each subband is encoded or it is encoded using an ACELP scheme or a sinusoidal pulse coding scheme. The sinusoidal pulse coding scheme encodes the code information, size and position of an MDCT coefficient that affects the quality of a synthesized signal.

In general, a variable-band extension codec uses a layered coding scheme in order to provide a plurality of bit rates. For example, if a total of 20 kbit/s signals are used to encode a high-low-frequency signal and a signal failing to be processed by a narrowband codec, 20 kbit/s signals are not simultaneously used but a 2 kit/s signal is allocated to each layer. Accordingly, the bit rate can be controlled by the unit of 2 kbit/s. If it is encoded by allocating a 2 kit/s signal to each layer, a frequency band may be divided into a plurality of subbands and then some of the subbands may be encoded by 2 kbit/s. As another example, the entire frequency band may be encoded by 2 kbit/s and then an error signal may be calculated to encode it by 2 kbit/s. A suitable scheme may be selected in consideration of the audio quality, the calculation amount, and the structure of a codec.

If a bit rate is restricted when a signal is modeled by a sinusoidal pulse coding scheme like the exemplary case of the variable-band extension codec, bit allocation may vary according to the importance of each subband in consideration of the auditory characteristics of humans. This structure is very efficient in terms of the sound quality versus the bit rate. However, if a quantization error occurs in a subband allocated less bits, the sound quality may be degraded due to a quantization step difference. In particular, if signals having a small time-axis change over the entire frequency band (e.g., signals of musical instruments such as pianos and violins) are encoded by a sinusoidal pulse coding scheme, the time-axis change of the phase, size and code of pulses over the entire frequency band must be very small. However, if a quantization error occurs in a subband with a large quantization step due to less bit allocation, the overall quality of synthesized signals may be degraded.

If it is predicted that the quality of a synthesized signal is degraded due to time-axis discontinuity, a time-axis smoothing scheme or a coding scheme reflecting time-axis change characteristics is used to compensate for the discontinuity and improve the sound quality. As an example of the scheme reflecting time-axis change characteristics in a sinusoidal pulse coding scheme, there is a scheme that models a signal by a damped sinusoid and estimates the time-axis change characteristics by a sliding window ESPRIT (Estimation of Signal Parameter via Rotational Invariance Techniques) scheme. The damped sinusoid modeling scheme models a signal by a sinusoidal pulse and attenuation parameters on the assumption that a musical instrument signal attenuates after the generation of an initial sound. The sliding window ESPRIT scheme estimates an attenuation parameter vector on the basis of the correlation with adjacent analysis frames.

If sinusoidal pulse coding is performed reflecting the subband characteristics of a signal with time-axis continuity, in particular, if bit allocation for each subband varies like the exemplary case of the variable-band extension codec, when the all-band signals are simultaneously smoothed like the conventional scheme, an unnecessary subband may be smoothed, thus degrading the sound quality. In particular, the sound quality degradation is noticeable in signals with different time-axis change characteristics for the respective subbands. The use of a scheme capable of estimating time-axis change characteristics for each subband like the damped sinusoid modeling scheme can solve the problems of the conventional smoothing method, but may greatly increase the calculation complexity.

The present invention is to solve such problems. The present invention provides a method and an apparatus for decoding an audio signal encoded by a layered sinusoidal pulse coding scheme using one or more sinusoidal pulses, which can reduce a decoding operation time and improve the quality of a synthesized signal by variably setting a frequency band to be smoothed.

If a low calculation complexity is required, it is difficult to use the conventional time-axis modeling scheme with a high calculation complexity. Also, when an audio signal with time-axis continuity is encoded, the use of the conventional all-band smoothing scheme may degrade the sound quality. Thus, the present invention is to minimize an increase in the calculation amount and to prevent the discontinuity due to a possible quantization error in the conventional smoothing method, thus improving the quality of a synthesized signal.

The audio decoding method and apparatus of the present invention is applied to an audio signal encoded by a variable-band extension codec and a layered sinusoidal pulse coding scheme. The following embodiment of the present invention will be described on the assumption of decoding an audio signal encoded by the variable-band extension codec of FIG. 1. Herein, a high-frequency signal of an audio signal inputted to the codec of FIG. 1 is transformed into an MDCT coefficient by the super-wideband extension coding module 114. The MDCT coefficient is divided into a plurality of subbands, and they are synthesized into a high-frequency signal by gain and shape coding. In order to more accurately represent the MDCT coefficient affecting the quality of a synthesized signal, the inputted audio signal and the gain and shape coding are used to encode a residual signal, corresponding to the difference from the synthesized signal, by a sinusoidal pulse. The sinusoidal pulse coding has a layered structure capable of controlling the bit rate by the unit of 4 kbit/s or 8 kbit/s.

When using the sinusoidal pulse coding scheme varying the bit allocation on a subband-by-subband basis like the above variable-band extension codec, the present invention performs time-axis smoothing on a subband-by-subband basis in a predetermined frequency band of a sinusoidal pulse signal in a decoding operation, thereby minimizing the calculation amount and improving the quality of a synthesized signal. The present invention variably sets a smoothing frequency band according to layer structures, thereby making it possible to maximally reduce the calculation amount.

Figure 3:
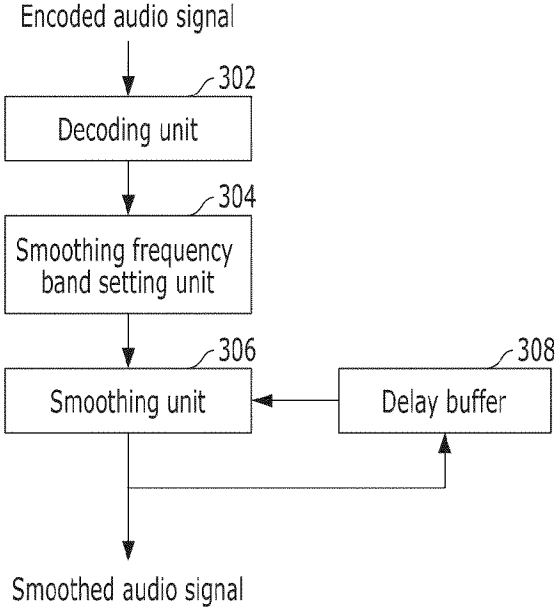
FIG. 3 is a block diagram of an audio signal decoding apparatus in accordance with an embodiment of the present invention.

FIG. 3 is a block diagram of an audio signal decoding apparatus in accordance with an embodiment of the present invention.

Referring to FIG. 3, an audio signal encoded by the layered sinusoidal pulse coding scheme and the variable-band extension codec of FIG. 1 is inputted to a decoding unit 302. The decoding unit 302 decodes the encoded audio signal prior to output.

The decoded audio signal outputted from the decoding unit 302 is inputted to a smoothing frequency band setting unit 304. The smoothing frequency band setting unit 304 sets a smoothing frequency band of the decoded audio signal according to a layer structure of the layered sinusoidal pulse coding scheme.

The smoothing frequency band setting unit 304 may variably set the smoothing frequency band according to the number of bits allocated on a subband-by-subband basis, when encoding the inputted audio signal, in the layered sinusoidal pulse coding scheme. When the variable-band extension coded of FIG. 1 is used to encode the audio signal, the bit allocation for each subband does not increase linearly but increases nonlinearly according to the coding scheme or converges at a random time point. Thus, the smoothing frequency band setting unit 304 can reflect a bit allocation scheme in an encoding operation when setting the smoothing frequency band. That is, it does not apply smoothing to the band with insufficient bit allocation in an encoding operation, thereby making it possible to better represent a time-axis change.

The smoothing frequency band setting unit 304 may set the smoothing frequency band according to the static characteristics of the encoded audio signal. Herein, the static characteristics of the encoded audio signal mean the size of a time-axis change of the audio signal.

When the smoothing frequency band is determined by the smoothing frequency band setting unit 304, a smoothing unit 306 divides the determined smoothing frequency band into one or more subbands. The smoothing unit 306 smooths the decoded audio signal on a subband-by-subband basis. Herein, the position, gain factor and code of the sinusoidal pulse used to encode the audio signal may also be smoothed.

The audio signal decoding apparatus of the present invention may further include a delay buffer 308. The delay buffer 308 stores an audio signal of the previous frame for time-axis smoothing. The smoothing unit 306 may smooth an audio signal of the current frame with reference to an audio signal of the previous frame stored in the delay buffer 308.

Figure 4:
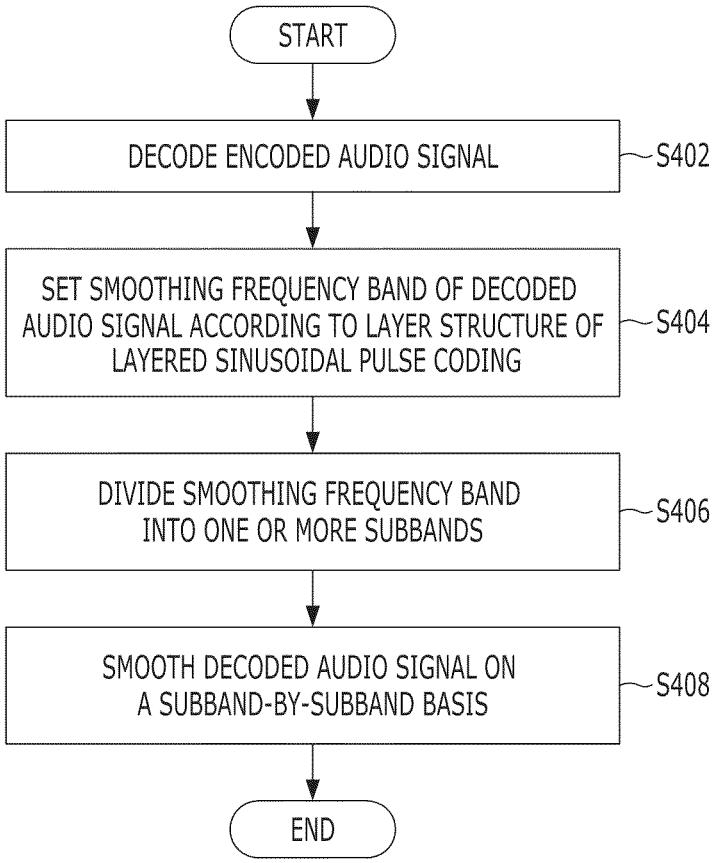
FIG. 4 is a flow diagram illustrating an audio signal decoding method in accordance with an embodiment of the present invention.

FIG. 4 is a flow diagram illustrating an audio signal decoding method in accordance with an embodiment of the present invention.

Referring to FIG. 4, an audio signal encoded by a layered sinusoidal pulse coding scheme using one or more sinusoidal pulses is decoded (S402). A smoothing frequency band of the decoded audio signal is set according to a layer structure of the layered sinusoidal pulse coding scheme (S404).

The smoothing frequency band may be variably set according to the number of bits allocated on a subband-by-subband basis, when encoding the audio signal, in the layered sinusoidal pulse coding scheme.

The set smoothing frequency band is divided into one or more subbands (S406), and the decoded audio signal is smoothed on a subband-by-subband basis. Herein, the decoded audio signal of the current frame may be smoothed with reference to a prestored audio signal of the previous frame of the decoded audio signal. In step S408, the position, gain factor and code of the sinusoidal pulse used to encode the audio signal may be smoothed.

Hereinafter, an audio signal decoding method of the present invention will be described with reference to an embodiment that uses the variable-band extension codec of FIG. 1 to transform a high-frequency (7-14 kHz) signal into an MDCT domain and decode the signal encoded by the sinusoidal pulse coding scheme.

Figure 5:
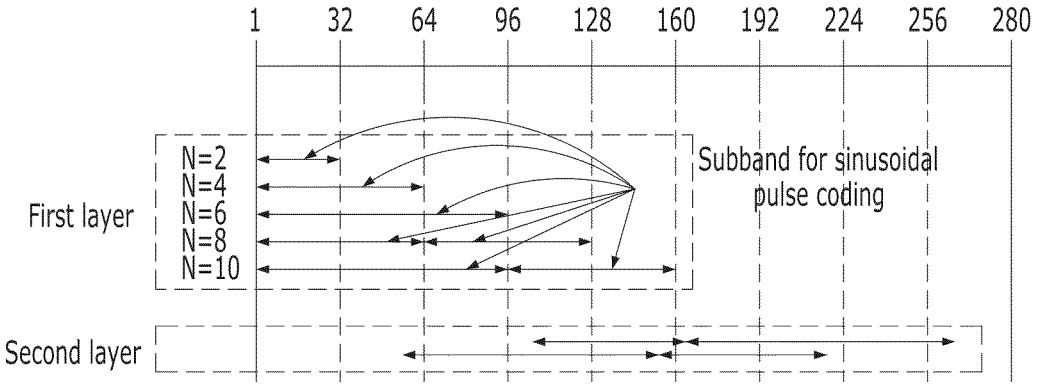
FIG. 5 is a diagram illustrating an exemplary case of performing sinusoidal pulse coding throughout two layers in order to encode 280 MDCT coefficients corresponding to 7-14 kHz.

FIG. 5 is a diagram illustrating an exemplary case of performing sinusoidal pulse coding throughout two layers in order to encode 280 MDCT coefficients corresponding to 7-14 kHz. Referring to FIG. 5, a first layer performs an encoding operation by variably setting the number N of sinusoidal pulses and a coding band, and a second layer performs an encoding operation by using a predetermined number of pulses in a predetermined subband.

After the audio signal encoded by the layered sinusoidal pulse coding scheme is inputted and decoded, the present invention may set a smoothing frequency band as follows. For example, if the number N of sinusoidal pulses in the first layer is 4, the smoothing frequency band setting unit 304 of FIG. 3 may set the smoothing frequency band to 64-280 (8.6-14 kHz); and if the number N of sinusoidal pulses in the first layer is 6, the smoothing frequency band setting unit 304 of FIG. 3 may set the smoothing frequency band to 96-280 (9.4-14 kHz). If a subband with sufficient bit allocation is present in an upper layer, the present invention excludes a smoothing operation on the corresponding band on the assumption that a quantization error will be removed in such a case. Accordingly, the present invention can reduce the calculation amount required for the smoothing operation.

When the smoothing frequency band setting unit 304 sets the smoothing frequency band as described above, the smoothing unit 306 divides the set smoothing frequency band into one or more subbands in consideration of the coding scheme and the characteristics of the audio signal. Thereafter, the smoothing unit 306 performs a smoothing operation on a subband-by-subband basis. The smoothing unit 306 may perform the smoothing operation with reference to a signal of the previous frame stored in the delay buffer 308. Herein, the smoothing operation includes both a smoothing operation on a gain factor including a code and a smoothing operation on the position of a pulse. In this manner, the present invention performs a time-axis smoothing operation on a subband-by-subband basis, thereby making it possible to maximally reflect the time-axis characteristics of each subband and to improve the quality of the decoded audio signal. Meanwhile, if an encoding operation is performed by dividing a subband by a size of 32 (0.8 Hz) as illustrated in FIG. 4, the smoothing unit 306 may divide the smoothing frequency band into subbands of the same size.

Figure 6A:
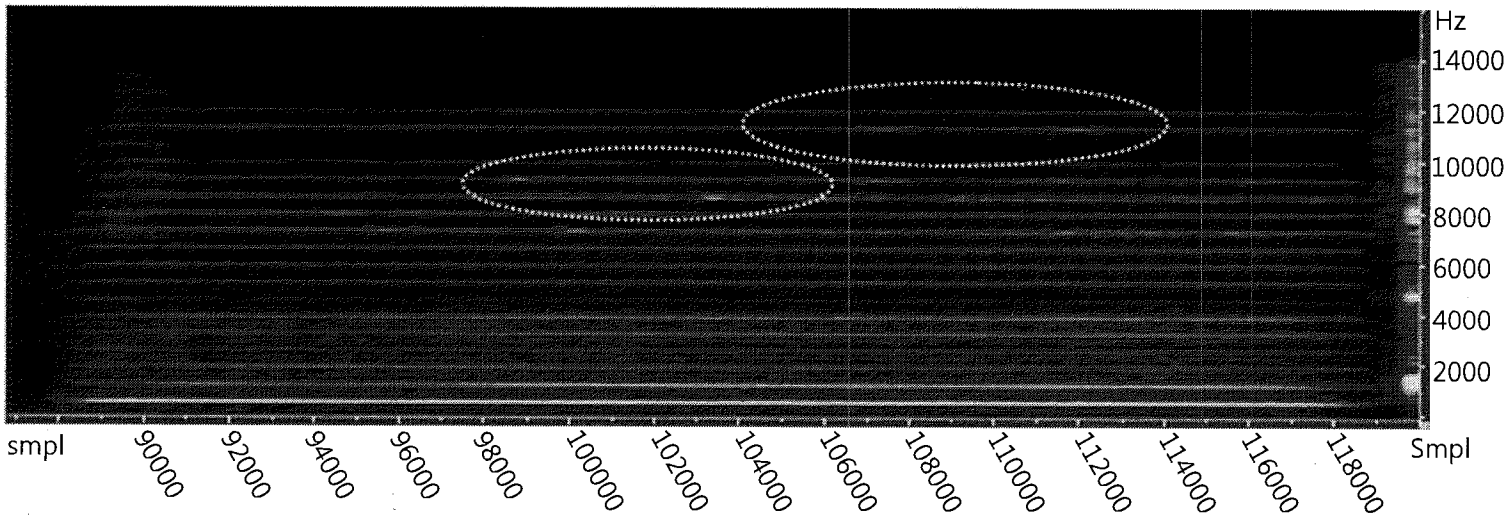
FIGS. 6A and 6B are graphs comparing the result of the case of performing an audio decoding method of the present invention with the result of the case of not performing the audio decoding method of the present invention.
Figure 6B:
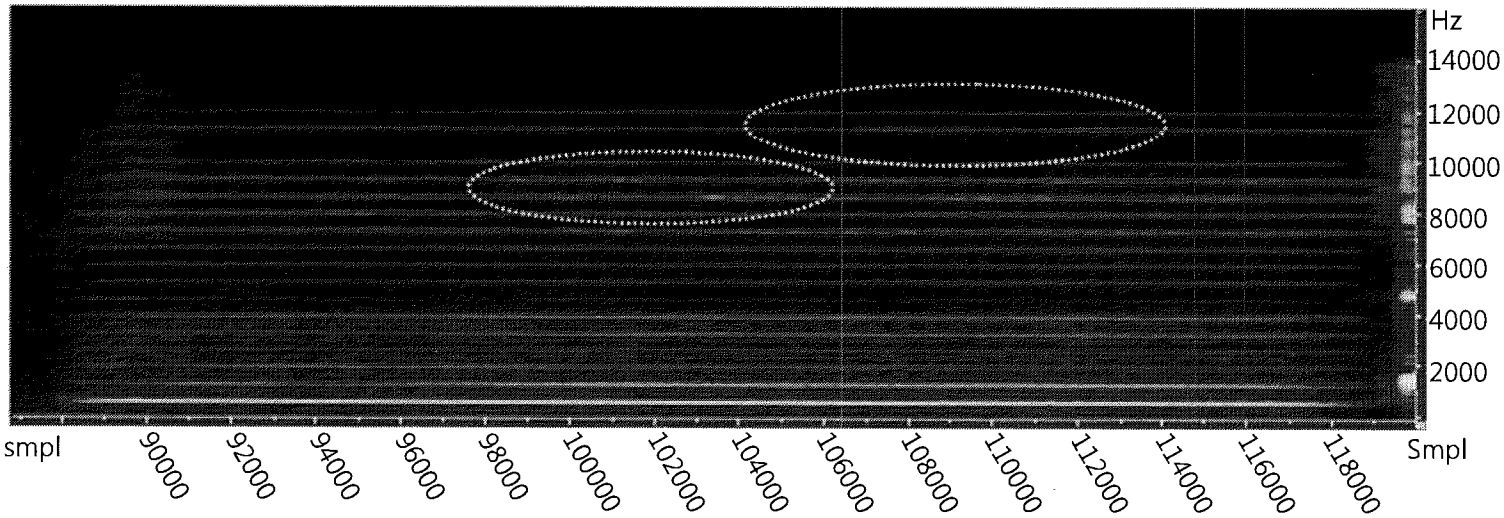

FIGS. 6A and 6B are graphs comparing the result of the case of performing an audio decoding method of the present invention with the result of the case of not performing the audio decoding method of the present invention. In FIGS. 6A and 6B, the axis of abscissas represents a time, and the axis of ordinates represents a frequency. FIG. 6A illustrates a signal in the case of not performing the audio decoding method in accordance with the present invention, and FIG. 6*b* illustrates a signal in the case of performing the audio decoding method in accordance with the present invention. The signal of FIG. 6A has noticeable time-axis discontinuity due to a quantization error at portions represented by dotted ellipses. However, in FIG. 6B, most of such portions are removed, and it can be seen that the sound quality is improved.

When decoding an audio signal encoded by a layered sinusoidal pulse coding scheme, the audio signal decoding method and apparatus of the present invention sets a smoothing frequency band by reflecting the signal characteristics and the coding scheme for each subband, divides the set smoothing frequency band into one or more subbands, and performs a time-axis smoothing operation on a subband-by-subband basis. Accordingly, as compared to the conventional all-band smoothing method, the present invention can reduce the calculation amount and can improve the quality of a synthesized signal.

Figure 7:
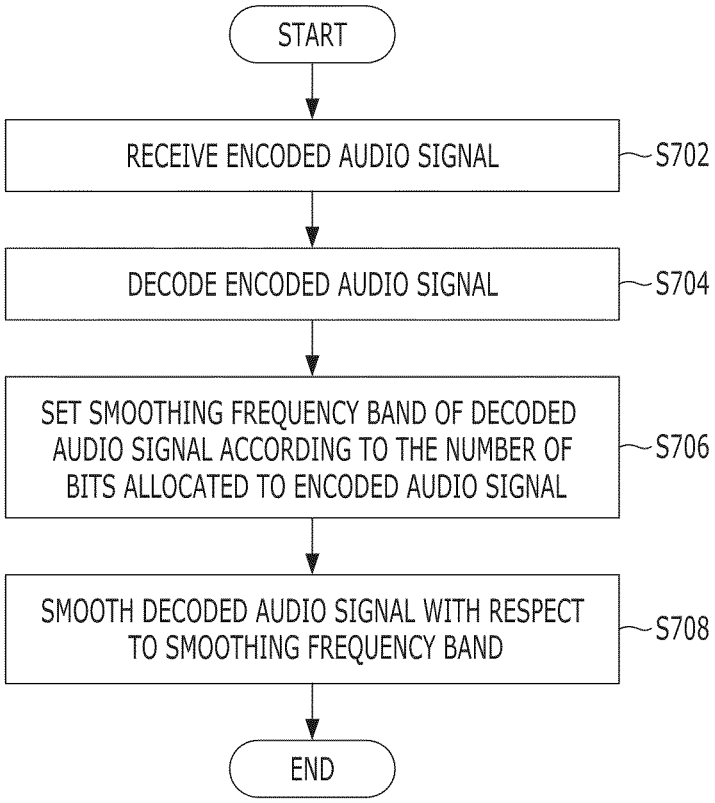
FIG. 7 is a flow diagram illustrating an audio signal decoding method in accordance with another embodiment of the present invention.

FIG. 7 is a flow diagram illustrating an audio signal decoding method in accordance with another embodiment of the present invention.

Referring to FIG. 7, an encoded audio signal is inputted (S702), and the encoded audio signal is decoded (S704).

Thereafter, a smoothing frequency band of the decoded audio signal is set according to the number of bits allocated to the encoded audio signal (S706). As described above, if a subband with sufficient bit allocation is present in an upper layer, the present invention excludes a smoothing operation on the assumption that a quantization error will be removed in such a case. Accordingly, the present invention can reduce the calculation amount required for the smoothing operation.

With respect to the smoothing frequency band set in the step S706, the decoded audio signal is smoothed (S708). In the step S708, the set smoothing frequency band may be divided into one or more subbands, and a smoothing operation may be performed on the subbands. As described above, time-axis smoothing is performed on a subband-by-subband basis, thereby making it possible to maximally reflect the time-axis characteristics of each subband and improve the quality of the decoded audio signal. Also, when smoothing is performed in the step S708, the decoded audio signal may be smoothed with reference to a prestored audio signal of the previous frame of the decoded audio signal.

As described above, when decoding an audio signal encoded by a layered sinusoidal pulse coding scheme using one or more sinusoidal pulses, the present invention variably sets a frequency band to be smoothed, thereby making it possible to reduce a decoding operation time and to improve the quality of a synthesized signal.

While the present invention has been described with respect to the specific embodiments, it will be apparent to those skilled in the art that various changes and modifications may be made without departing from the spirit and scope of the invention as defined in the following claims.

What is claimed is:

1. A method for decoding an audio signal encoded by a layered sinusoidal coding scheme using one or more sinusoidal pulses, comprising:

decoding the encoded audio signal;

setting a smoothing frequency band of the decoded audio signal according to a layer structure of the layered sinusoidal coding scheme;

dividing the smoothing frequency band into one or more subbands; and smoothing a time-axis of the decoded audio signal on a subband-by-subband basis, wherein the smoothing of the time-axis of the decoded audio signal on a subband-by-subband basis comprises smoothing position, gain factor, and code of a sinusoidal pulse used to encode the audio signal.

2. The method of claim 1, wherein the setting a smoothing frequency band of the decoded audio signal according to a layer structure of the layered sinusoidal coding scheme comprises setting the smoothing frequency band variably according to the number of bits allocated on a subband-by-subband basis when encoding the audio signal by the layered sinusoidal coding scheme.

3. The method of claim 1, wherein the setting a smoothing frequency band of the decoded audio signal according to a layer structure of the layered sinusoidal coding scheme comprises setting the smoothing frequency band according to static characteristics of the encoded audio signal.

4. The method of claim 1, wherein the smoothing of the time-axis of the decoded audio signal on a subband-by-subband basis comprises smoothing of the time-axis of the decoded audio signal with reference to a prestored audio signal of the previous frame of the decoded audio signal.

5. An apparatus for decoding an audio signal encoded by a layered sinusoidal coding scheme using one or more sinusoidal pulses, comprising one or more processors configured to embody a plurality of functional units including:

a decoding unit configured to decode the encoded audio signal;

a smoothing frequency band setting unit configured to set a smoothing frequency band of the decoded audio signal according to a layer structure of the layered sinusoidal coding scheme; and a smoothing unit configured to divide the smoothing frequency band into one or more subbands and smooth a time-axis of the decoded audio signal on a subband-by-subband basis, wherein the smoothing unit smooths position, gain factor, and code of a sinusoidal pulse used to encode the audio signal.

6. The apparatus of claim 5, wherein the smoothing frequency band setting unit sets the smoothing frequency band variably according to the number of bits allocated on a subband-by-subband basis when encoding the audio signal by the layered sinusoidal coding scheme.

7. The apparatus of claim 5, wherein the smoothing frequency band setting unit sets the smoothing frequency band according to static characteristics of the encoded audio signal.

8. The apparatus of claim 5, further comprising a delay buffer configured to store an audio signal of the previous frame of the decoded audio signal, wherein the smoothing unit smooths the time-axis of the decoded audio signal with reference to an audio signal of the previous frame of the decoded audio signal prestored in the delay buffer.

9. An audio signal decoding method comprising:

receiving an encoded audio signal;

decoding the encoded audio signal;

setting a smoothing frequency band of the decoded audio signal according to the number of bits allocated to the encoded audio signal; and smoothing a time-axis of the decoded audio signal with respect to the smoothing frequency band, wherein the smoothing of the time-axis of the decoded audio signal with respect to the smoothing frequency band comprises smoothing position, gain factor, and code of a sinusoidal pulse used to encode the audio signal.

10. The audio signal decoding method of claim 9, wherein the smoothing of the time-axis of the decoded audio signal with respect to the smoothing frequency band comprises:

dividing the smoothing frequency band into one or more subbands; and smoothing of the time-axis of the decoded audio signal on a subband-by-subband basis.

11. The audio signal decoding method of claim 9, wherein the smoothing of the time-axis of the decoded audio signal with respect to the smoothing frequency band comprises smoothing of the time-axis of the decoded audio signal with reference to a prestored audio signal of the previous frame of the decoded audio signal.

12. The method of claim 3, wherein the static characteristics of the encoded audio signal is the size of a time-axis change of the audio signal.

13. The apparatus of claim 7, wherein the static characteristics of the encoded audio signal is the size of a time-axis change of the audio signal.

* * * * *